US005911316A

United States Patent [19]

Chu

[11] Patent Number: 5,911,316

[45] Date of Patent: Jun. 15, 1999

[54] DEVICE FOR MANUALLY TURNING-ON CIRCUIT-BREAKERS

[75] Inventor: Chien-Ming Chu, Taoyuan Hsien, Taiwan

[73] Assignee: Acbel Polytech, Inc., Taipei, Taiwan

[21] Appl. No.: 09/135,396

[22] Filed: Aug. 17, 1998

[51] Int. Cl.[6] ..... H01H 3/20

[52] U.S. Cl. ..... 200/331; 200/332; 200/337; 200/538

[58] Field of Search ..... 200/43.11, 331, 200/332, 337, 330, 519, 538

[56] References Cited

U.S. PATENT DOCUMENTS

| | | | |
|---|---|---|---|
| 4,168,407 | 9/1979 | Wiktor | 200/18 |
| 4,168,417 | 9/1979 | Puetz et al. | 200/330 |
| 5,424,500 | 6/1995 | Smith | 200/50 A |

*Primary Examiner*—Michael L. Gellner
*Assistant Examiner*—Lee S. Lum
*Attorney, Agent, or Firm*—Kolisch Hartwell Dickinson McCormack & Heuser

[57] ABSTRACT

A device for manually turning-on at least one circuit-breaker from the front panel of a cabinet includes at least one sleeve having a front end and a rear end. The sleeve extends through an aperture in the front panel and is movable between a backward position, in which the front end of the sleeve projects slightly from the front panel, and a forward position, in which the front end of the sleeve projects away from the front panel. A spring is compressed to push the sleeve from the forward position to the backward position. A rod is operably connected to the sleeve so as to be displaced following the forward movement of the sleeve and to remain in its position uneffected by the backward movement of the sleeve. A linking bar is provided to interconnect the rod and a switch member of the circuit-breaker, and the linking bar is adjustably connected to the rod so that the backward position of the sleeve correlates with the turned-off position of the circuit-breaker and the forward position of the sleeve correlates with the turned-on position of the circuit-breaker.

7 Claims, 6 Drawing Sheets

DEVICE FOR MANUALLY TURNING-ON CIRCUIT-BREAKERS

FIELD OF THE INVENTION

The present invention relates to a device for manually turning-on circuit-breakers and, more particularly, to a device which may be manually operated to turn-on circuit-breakers without producing electromagnetic interference and occupying additional space.

BACKGROUND OF THE INVENTION

An electrical supply unit, such as a regulated rectifier, usually has a AC circuit-breaker positioned adjacent to the inlet (alternating voltage) and a DC circuit-breaker positioned to the outlet (direct voltage) thereof. Because the inlet and outlet of such a regulated rectifier are typically designed in a rear panel of a cabinet in which the supply unit is installed, e.g. in a position difficult to access, the unit must be taken out of the cabinet before the circuit-breakers are manually turned-on from a turned-off position caused by a current overload. Although changing the position of the circuit-breakers from the rear panel to the front panel may be helpful in the operation of the circuit breakers, a problem of electromagnetic interference inevitably produced by a long wire electrically interconnecting the rectifier and the circuit-breaker will occur.

SUMMARY OF THE INVENTION

The object of the present invention is to provide a device which may be manually operated at the front panel of the cabinet to turn-on circuit-breakers while producing no electromagnetic interference and occupying no additional space.

DETAILED DESCRIPTION OF PREFERRED EMBODIMENT

Figure 1:
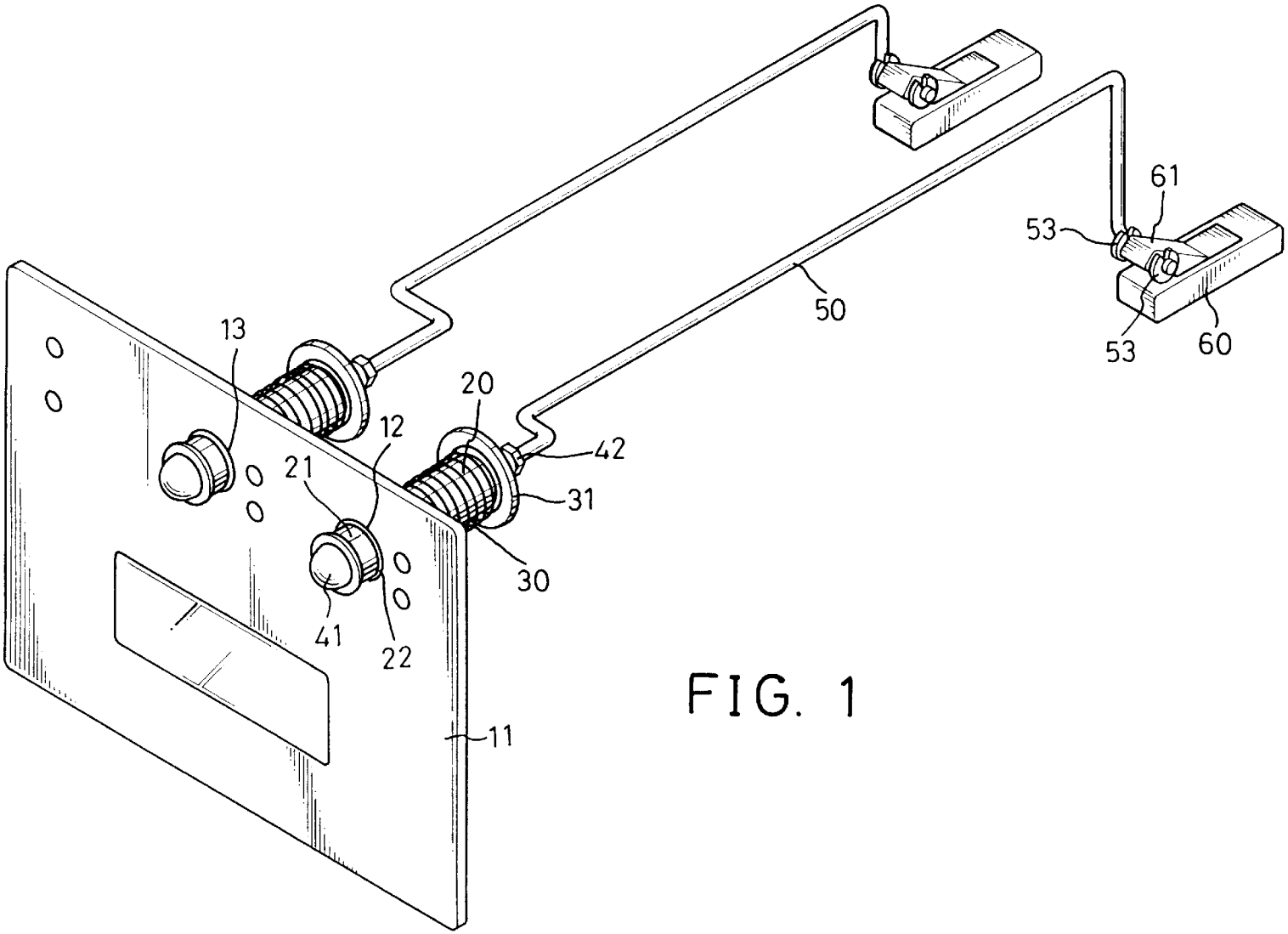
FIG. 1 a perspective view of a preferred embodiment of a device in accordance with the present invention for turning-on circuit-breakers.
Figure 2:
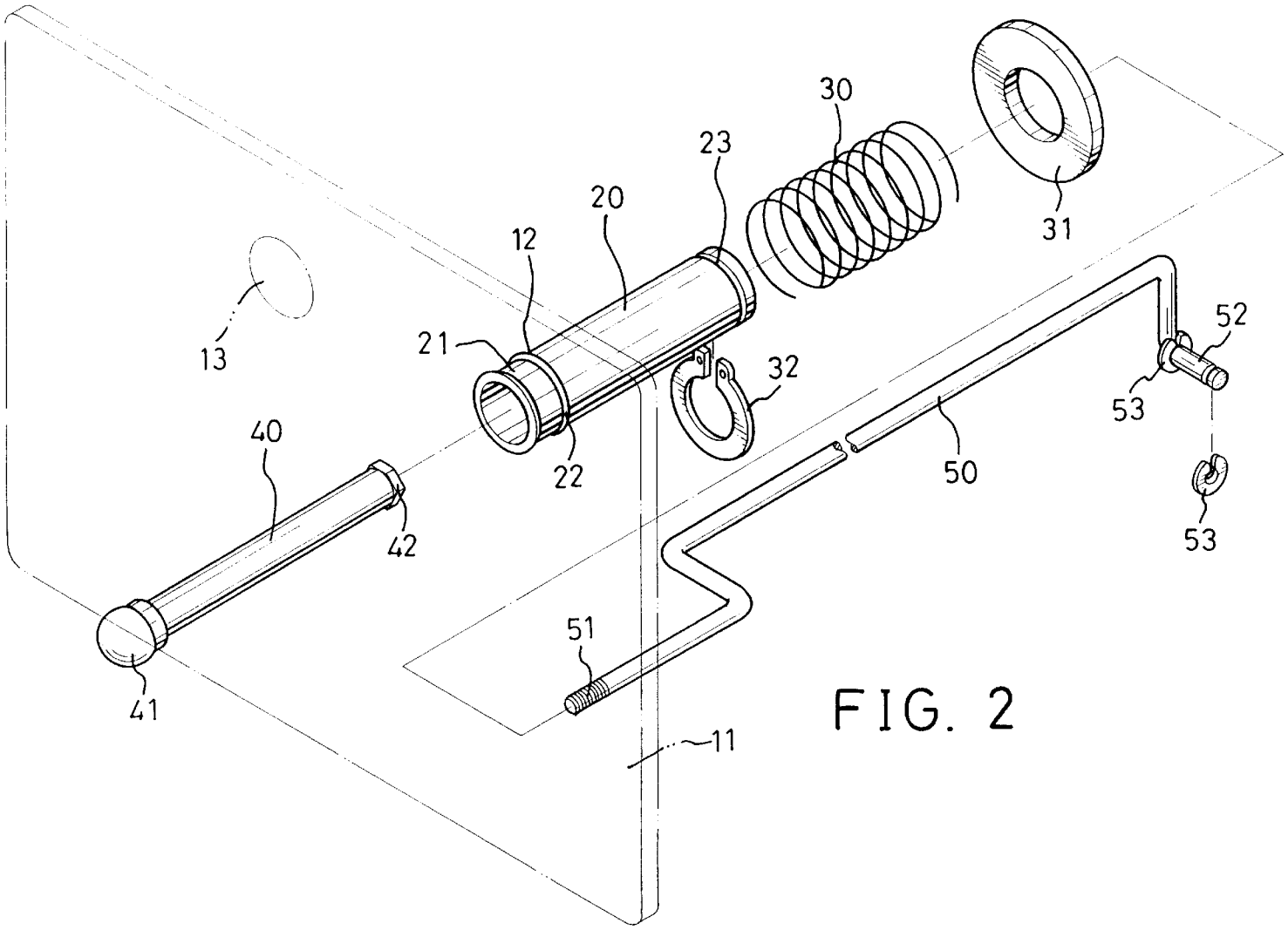
FIG. 2 is a perspective exploded view of the device shown in FIG. 1.
Figure 3:
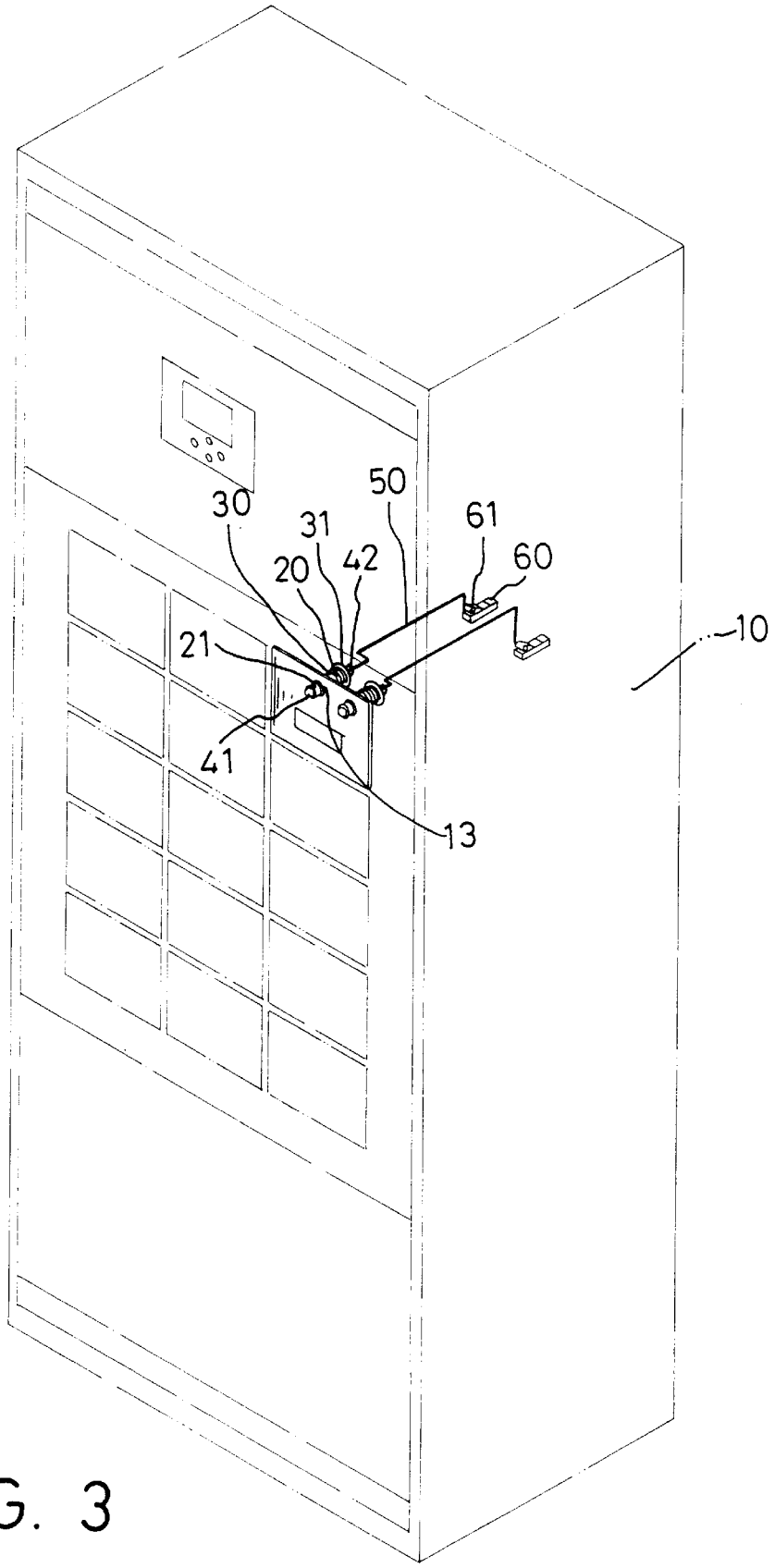
FIG. 3 is a perspective view of the device installed in a cabinet.

FIGS. 1, 2 and 3 show a preferred embodiment of a device constructed in accordance with the present invention for turning-on at least one circuit-breaker (60) installed in a cabinet (10). As illustrated, the cabinet (10) includes a front panel (11) having a pair of apertures (12, 13) defined therein, optionally, with designations of AC INPUT and DC OUTPUT (both not shown) inscribed above the apertures (12, 13) on the front panel (11).

Figure 4:
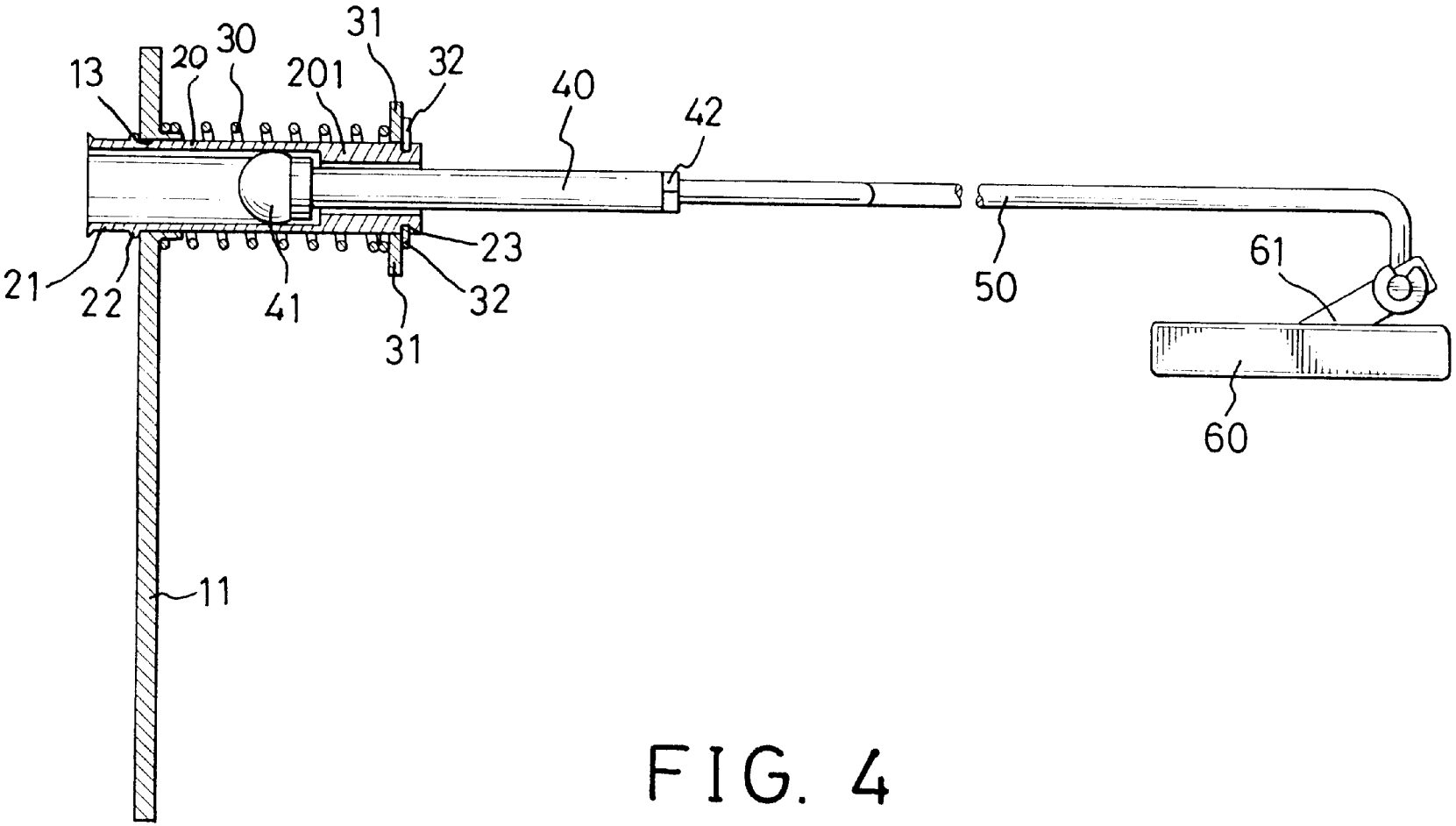
FIG. 4 is a partially cross-sectional side view showing the device in a position corresponding to the turned-off position of a circuit-breaker.
Figure 5:
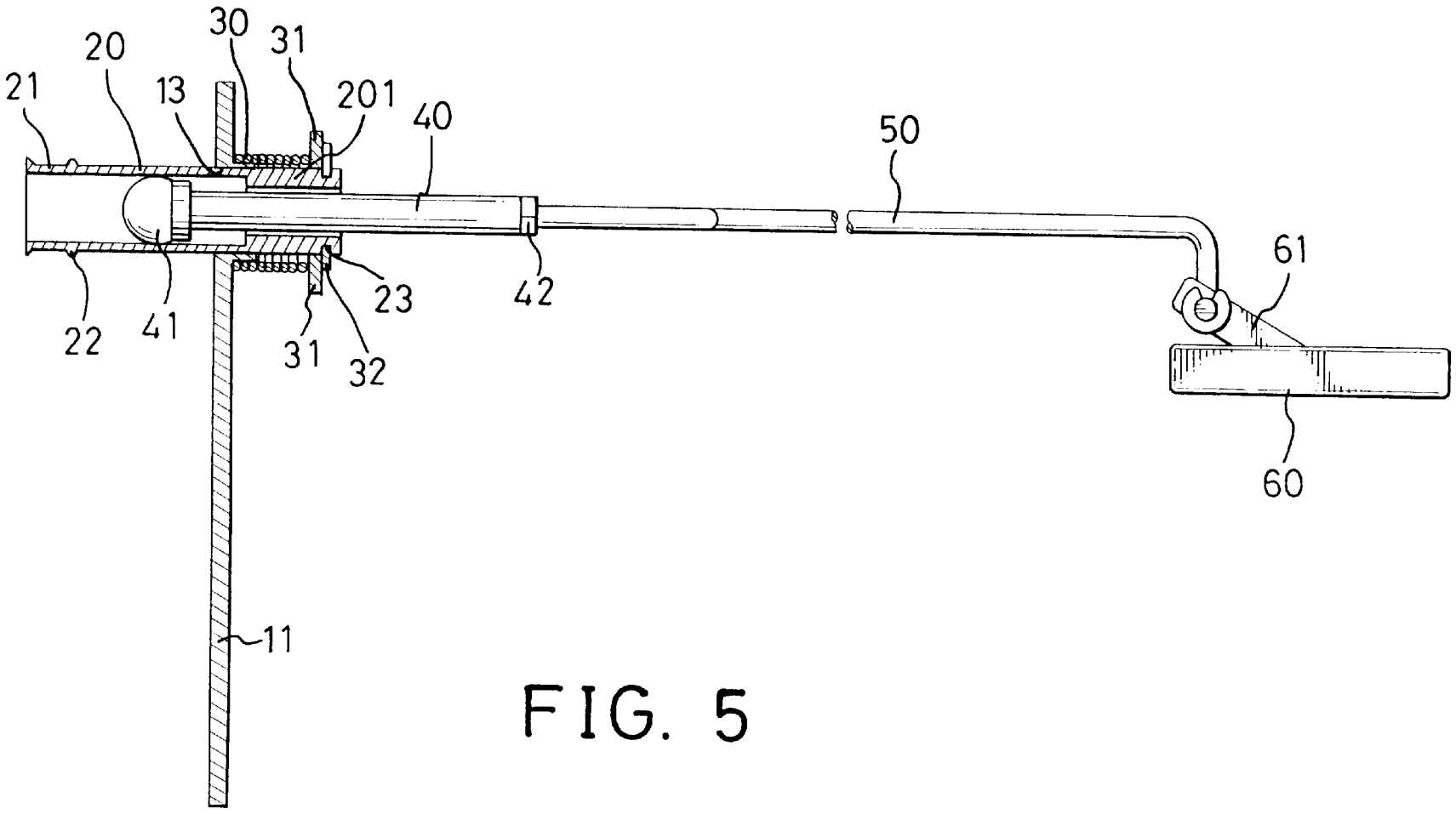
FIG. 5 is a partially cross-sectional view side showing the device in a position corresponding to the turned-on position of the circuit-breaker.

Referring to FIGS. 2 and 4, a sleeve (20) having a front end and a rear end extends through each aperture 12 and 13. The sleeve (20) is movable between a backward position, in which the front end of the sleeve (20) is projected slightly from the front panel (11), as shown in FIG. 4, and a forward position, in which the front end of the sleeve (20) projects from the front panel (11) very much, as shown in FIG. 5.

The sleeve (20) includes a handle section (21), defined between the front end and a flange (22) of the sleeve (20), to allow pulling the sleeve (20) forward by an operator hand. The flange (22) is formed on the outer periphery of the sleeve (20) and dimensioned to prevent further backward movement of the sleeve (20) through the aperture (12, 13), so as to limit the backward position of the sleeve (20). An annular groove (23) is defined on the outer periphery of the sleeve (20) adjacent to the rear end thereof.

A spring (30) is mounted around the sleeve (20) and compressed between the front panel ( 11) and a collar (31) that is coaxially abutted against a first C-ring (32) snapped into the annular groove (23) of the sleeve (20), for the purpose of pushing the sleeve (20) from the forward position to the backward position.

The sleeve (20) also has a stop portion (201) formed thereinside to cooperate with a rod (40) loosely fit into the sleeve (20) and having an enlarged front end (41) operably connected to the stop portion (201) so that the rod (40) may be displaced following the forward movement of the sleeve (20) and remain in its place ignoring the backward movement of the sleeve (20). Additionally, the rod (40) has a nut (42) secured at the rear end thereof.

A linking bar (50) is provided to interconnect the rod (40) and a switch member (61) of the circuit-breaker (60).The linking bar (50) has a threaded front end (51) threadingly engaged with the nut (42) of the rod (40), and a rear bent portion (52) to laterally extend through the switch member (61) of the circuit-breaker (60), with a pair of second C-rings (53) disposed around the rear bent portion (52) and at lateral sides of the switch member (61) to prevent the decoupling of the rear portion (52) from the switch member (61).

The nut (42) and the threaded front end (51) provides an adjustable connection between the rod (40) and the linking bar (50), varying the distance from the rod (40) to the switch member (61) of the circuit-breaker (60), so that the backward position of the sleeve (20) correlates with the turned-off position of the circuit-breaker (60) and the forward position of the sleeve (20) correlates with the turned-on position of the circuit-breaker (60).

The linking bar (50) is serpentine so that no other element installed in the cabinet (10) will interfere therewith.

Referring again to FIG. 4, when the circuit-breaker (60) is shifted to its turned-off position, i.e. the backward angular position of the switch member (60) in FIG. 4, by a current overload, the operator can reset the circuit-breaker by pulling the sleeve (20) towards its forward position with his/her fingers gripping the handle section (21)

During this process, as shown in FIG. 5, the spring (30) is much compressed, and both the rod (40) and the linking bar (50) are displaced following the forward movement of the sleeve (20), due to the relationship between the stop portion (201) of the sleeve (20) and the enlarged front end (41) of the rod (40), as well as the threaded connection of the nut (42 ) and the threaded front end (51) of the linking bar (50). This causes the switch member (61) to be pivoted towards the forward angular position thereof, i.e. the turned-on position of the circuit-breaker (60), as a result of the motion of the rear bent portion (52) of the linking bar (50).

Figure 6:
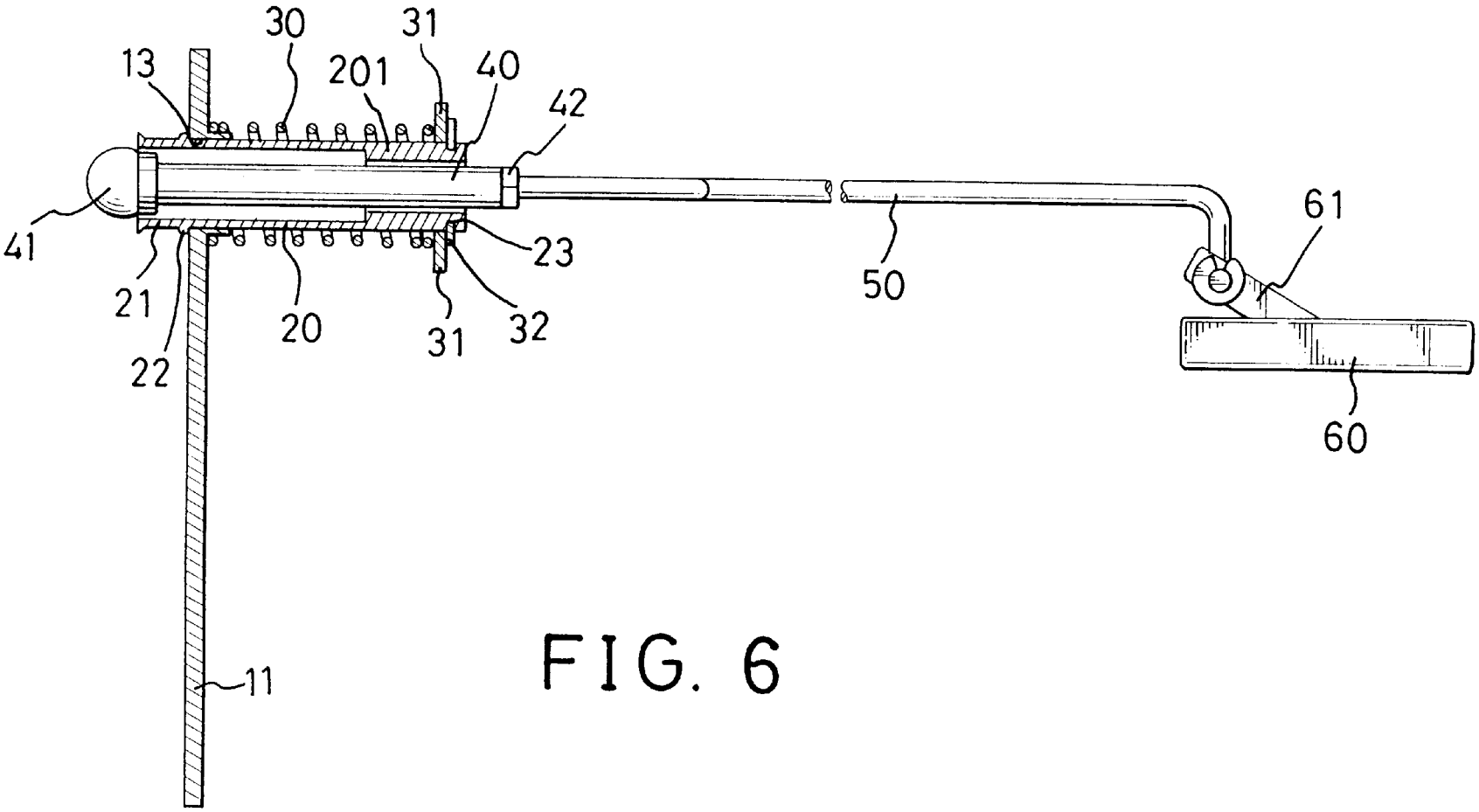
FIG. 6 is a partially cross-sectional side view showing the device in an operational position with the circuit-breaker maintained in the turned-on position.

Referring to FIG. 6, the travel of the sleeve (20) is stopped when the switch member (61) reaches the forward angular position thereof, i.e. the turned-on position of the circuit-breaker (60), when the operator loosens his/her fingers to release the spring (30). The spring (30) pushes the sleeve (20) to its backward position. During this process, however, the relationship between the stop portion (201) and the enlarged front end (41) causes the rod (40) and the linking bar (50) to remain in their places, uneffected by the backward movement of the sleeve (20), so that the circuit-breaker (60) remains in the turned-on position.

From the foregoing, it is clear that with the device in accordance with the present invention, circuit-breakers (60) may be easily operated manually at the front panel of the cabinet (10), while they are installed in the back inner wall of the cabinet (10) where a electrical supply unit, such as a regulated rectifier, is disposed and electrically connected to the supply unit via a rather short wire, so that electromagnetic interference can be alleviated. Additionally, the curved linking bar (50) penetrating through gaps among the other elements in the cabinet (10) allows the cabinet (10) to be the same size as a conventional cabinet.

What is claimed is:

1. A device for manually turning-on at least one circuit-breaker from the front panel of a cabinet in which elements including said circuit-breaker are installed, comprising:

at least one sleeve having a front end and a rear end;

said sleeve extending through an aperture in said front panel and being movable between a backward position, in which said front end of said sleeve projects slightly from said front panel, and a forward position, in which said front end of said sleeve projects away from said front panel;

a spring compressed to push said sleeve from said forward position to said backward position;

a rod operably connected to said sleeve so as to be displaced following the forward movement of said sleeve and to remain in its position unaffected by the backward movement of said sleeve;

a linking bar for interconnecting said rod and a switch member of said circuit-breaker; and said linking bar being adjustably connected to said rod so that said backward position of said sleeve correlates with the turned-off position of said circuit-breaker and said forward position of said sleeve correlates with the turned-on position of said circuit-breaker.

2. The device as claimed in claim 1, wherein said sleeve has a flange formed on the outer periphery thereof between said front panel and said front end of said sleeve, and said flange is dimensioned to prevent further backward movement of said sleeve through said aperture in said front panel, thereby limiting said backward position of said sleeve.

3. The device as claimed in claim 1, wherein a section of said sleeve defined between said flange and said front end of said sleeve serves as a handle for pulling said sleeve forwardly to shift said switch member of said circuit-breaker from said turned-off position to said turned-on position.

4. The device as claimed in claim 1, wherein said sleeve has a stop portion formed thereinside, and wherein said rod is loosely fitted into said sleeve and has an enlarged front end operable to contact with said stop portion so as to be displaced following the forward movement of said sleeve and to remain in its position uneffected by the backward movement of said sleeve.

5. The device as claimed in claim 1, wherein said sleeve has an annular groove defined adjacent to said rear end thereof, and wherein a first C-ring is snapped into said annular groove of said sleeve with a collar coaxially abutted against said collar, thereby compressing said spring between said collar and said front panel.

6. The device as claimed in claim 1, wherein said rod has a nut secured at a rear end thereof, and wherein said linking bar has a threaded front end threadingly engaged with said nut of said rod, thereby providing the adjustable connection of said rod and said linking bar.

7. The device as claimed in claim 1, wherein said linking bar has a rear bent portion extending through said switch member of said circuit-breaker, and wherein a pair of second C-rings are disposed around said rear bent portion and at lateral sides of said switch member.

* * * * *